US011459172B2

(12) United States Patent
Martin, II et al.

(10) Patent No.: US 11,459,172 B2
(45) Date of Patent: Oct. 4, 2022

(54) CLOSURE DEVICE FOR WASTE CONTAINER

(71) Applicant: SERIO-US INDUSTRIES, INC., Baltimore, MD (US)

(72) Inventors: James L. Martin, II, Gambrills, MD (US); David L. Reeb, Sykesville, MD (US)

(73) Assignee: SERIO-US INDUSTRIES, INC., Baltimore, MD (US)

( * ) Notice: Subject to any disclaimer, the term of this patent is extended or adjusted under 35 U.S.C. 154(b) by 340 days.

(21) Appl. No.: 16/529,476

(22) Filed: Aug. 1, 2019

(65) Prior Publication Data

US 2021/0032022 A1 Feb. 4, 2021

(51) Int. Cl.
*B65F 1/16* (2006.01)
*B65F 1/02* (2006.01)

(52) U.S. Cl.
CPC ..... *B65F 1/1615* (2013.01); *B65F 1/02* (2013.01); *B65F 1/1646* (2013.01)

(58) Field of Classification Search
CPC ..... B65F 1/1615; B65F 1/1646; B65F 1/02
USPC ..... 220/318, 324, 326, 810–849, 908
See application file for complete search history.

(56) References Cited

U.S. PATENT DOCUMENTS 1,877,771 A * 9/1932 Lear ..... B25D 17/04 403/3
2,573,548 A * 10/1951 Cunningham ..... B65F 7/00 220/87.1
3,817,563 A * 6/1974 McGlothlin ..... B65F 1/1615 292/254
4,241,846 A * 12/1980 Murphy ..... B65D 45/28 220/318
4,643,380 A * 2/1987 Copeland ..... B65F 1/00 141/316
4,976,371 A * 12/1990 Wise ..... B65D 45/02 220/315
6,880,717 B1 * 4/2005 O'Conor ..... B65F 1/1615 220/315
7,343,648 B2 * 3/2008 Shaw ..... B60P 7/0823 24/265 CD
8,459,487 B2 * 6/2013 Sharma ..... B65F 1/1615 220/315
2008/0169289 A1 * 7/2008 Dawn ..... B65F 1/1615 220/315
2016/0052713 A1 * 2/2016 Paul ..... B65F 1/068 220/200
2016/0052714 A1 * 2/2016 McDade ..... B65F 1/1615 220/326
2018/0057254 A1 * 3/2018 Lawyer ..... B65F 1/1468
2021/0101742 A1 * 4/2021 Altadonna, Jr. ... B65D 43/0202

* cited by examiner

*Primary Examiner* — James N Smalley
(74) *Attorney, Agent, or Firm* — Berenato & White, LLC

(57) ABSTRACT

The invention generally relates to a closure device for waste containers, particularly residential or commercial waste containers. In particular, the invention relates to a waste container closure device which prevents the lid from opening when the container is accidentally tipped over on its side. The closure device contains two straps: a right side strap and a left side strap; two mounting devices: a right side mounting device and a left side mounting device; and one or more elastic members. Those components cooperate to allow the straps to connect over the top of the lid of the waste container to remain closed when it is accidentally tipped on its side.

19 Claims, 7 Drawing Sheets

CLOSURE DEVICE FOR WASTE CONTAINER

This application claims the benefit of priority of U.S. Provisional Patent Application No. 62/714,192, filed Aug. 3, 2018, which is incorporated herein by reference.

FIELD OF THE INVENTION

The present invention generally relates to closure devices for waste containers, particularly residential and commercial waste containers. In particular, the invention relates to a waste container closure device which prevents the lid from opening when the container is accidentally tipped over on its side.

BACKGROUND

As is well known, residential and commercial waste containers for use in residential or commercial applications, typically include a base structure selectively covered by a hinged lid. These containers usually contain a block-shaped container with a hinged lid attached to one side thereof. The containers may be emptied by an automated lifting device on certain waste removal vehicles, which tilts the waste containers for emptying the contents of the waste containers. The containers are usually lifted by the lifting mechanism and pivoted in some fashion, so that the hinged top of the container opens and the trash contained therein is emptied into the vehicle. The container is then returned to a position on the ground, and the hinged lid closes the top of the container.

The waste containers may be available for purchase by home owners from various home improvement or department stores. When the container is in an upright position, the lid is closed and prevents animals from accessing the waste within the container. However, when the container is tipped over on its side, e.g. by animals or by strong wind, the lid may open, spilling the contents of the container or allowing animals to access the interior of the container.

Therefore, there remains a need for a simple and inexpensive device that prevents the unintended opening of the waste container, such as by an accidental knockdown by wind or animals, or an accidental opening of the lid by gusting wind.

SUMMARY OF THE INVENTION

The present invention provides a closure device for a waste container that keeps the lid of the container closed when the container is knocked over on its side. The closure device, however, may be manually opened by a user for depositing waste or for a dumping operation. An aspect of the present invention provides a closure device that is designed to be mounted to the waste container. The closure device contains two straps, two mounting devices configured to mount on opposing sides of the container, and at least one elastic member connected to one or both of the straps. The straps are configured to pass through the mounting devices and to connected together over the lid of the container to prevent the lid from opening.

Another aspect of the present invention provides a waste container having the closure device mounted thereon.

Methods for making the different aspects of the present invention are also provided.

Other aspects of the invention, including apparatus, devices, kits, processes, and the like which constitute part of the invention, will become more apparent upon reading the following detailed description of the exemplary embodiments.

BRIEF DESCRIPTION OF THE DRAWINGS

The foregoing background and summary, as well as the following detailed description of the drawings, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE PREFERRED EMBODIMENT(S)

Figure 1:
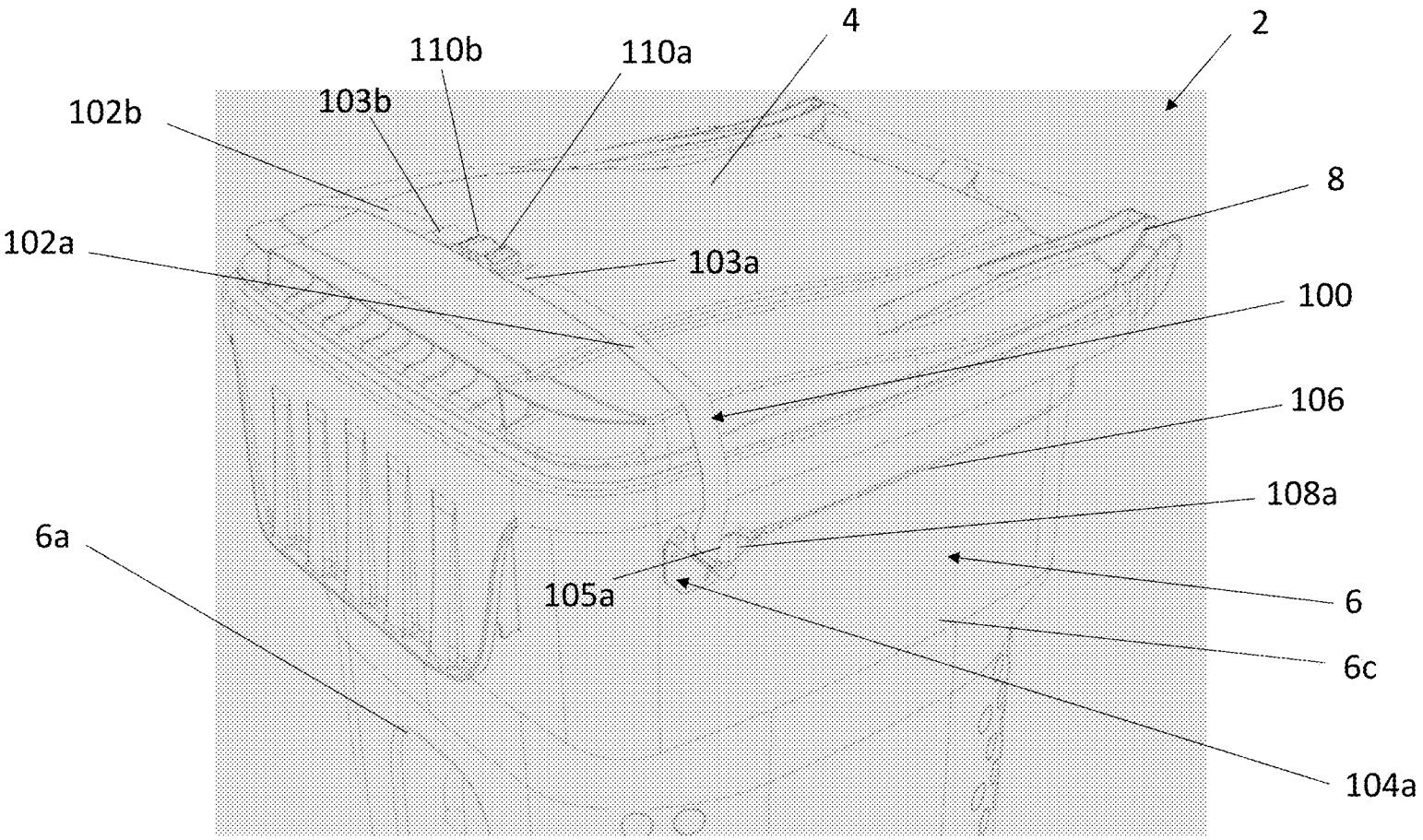
FIG. 1 shows a fragmentary perspective view of the front of the waste container having the closure device in the closed position.

The exemplary embodiment of the present invention will now be described with the reference to accompanying drawings. The following description of the preferred embodiment is merely exemplary in nature and is in no way intended to limit the invention, its application, or uses.

For purposes of the following description, certain terminology is used in the following description for convenience only and is not limiting. The characterizations of various components and orientations described herein as being "vertical," "horizontal," "upright," "right", "left," "side," "top," "bottom," or the like designate directions in the drawings to which reference is made and are relative characterizations only based upon the particular position or orientation of a given component as illustrated. These terms shall not be regarded as limiting the invention. The words "downward" and "upward" refer to position in a vertical direction relative to a geometric center of the apparatus of the present invention and designated parts thereof. The terminology includes the words above specifically mentioned, derivatives thereof and words of similar import.

Figure 2:
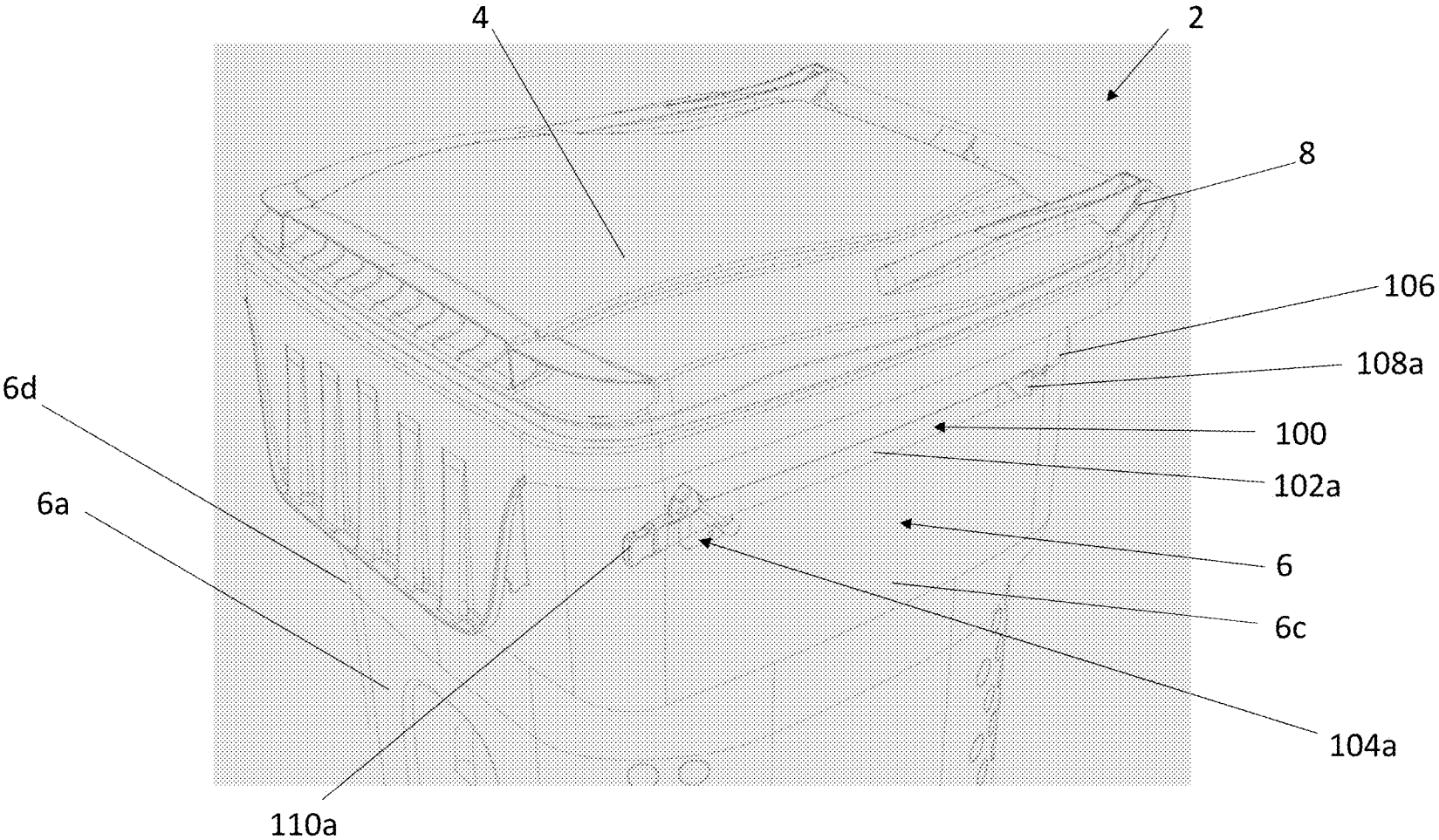
FIG. 2 shows a fragmentary perspective view of the front of the waste container having the closure device in the opened position.
Figure 3:
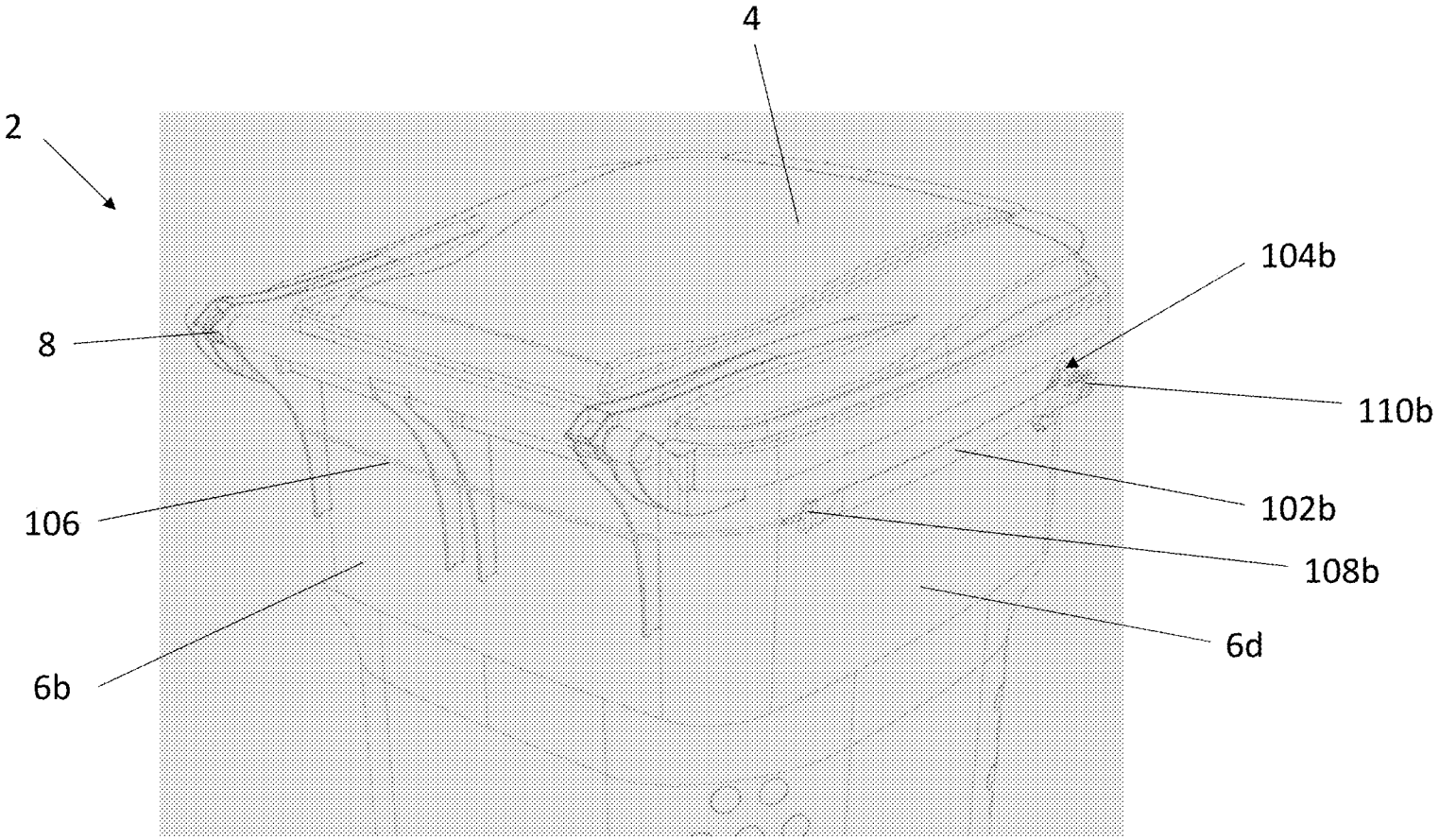
FIG. 3 shows a fragmentary perspective view of the rear of the waste container having the closure device in the opened position.

FIG. 1 illustrates a top portion of a waste container 2, such as a trash container typically used by home owners or businesses to deposit, retain, or store trash awaiting pick-up by a trash removal vehicle. The container 2 may be tilted or otherwise pivoted from an upright storage position (as shown in FIGS. 1-3) to a tilted or dumping position to empty its contents.

The container 2 has at least one lid 4 on top of a main box 6 that is open in order to expose the open interior. Box 6 defines an interior volume for holding waste. In a preferred embodiment, as shown in FIGS. 1-3, the main box 6 contains four walls: a front wall 6*a*, a rear wall 6*b* opposing the front wall 6*a*, a right wall 6*c* connecting the front wall 6*a* and the rear wall 6*b*, and a left wall 6*d* opposing the right wall 6*c* and also connecting the front wall 6*a* and the rear wall 6*b*. The lid 4 is mounted on a lid hinge 8, typically at the rear of the container 2, so that when an upward force is applied to the distal end of the lid 4, the lid 4 opens by pivoting on the lid hinge 8.

A closure device 100 is mounted to the container 2. The closure device 100 contains two straps: a right side strap 102*a* and a left side strap 102*b*, as best shown in FIG. 1 Two mounting devices are positioned on opposite sides of box 6 near the open top: a right side mounting device 104*a* and a left side mounting device 104*b*. One or more elastic members 106 are likewise positioned at the open top of box 6. There preferably two elastic straps 106, which are positioned on opposite sides of box 6. Henceforth, unless otherwise indicated, "elastic member 106" or the like should be read to include one or more elastic members. Both straps 102*a*, 102*b* are preferably identical. As such, any description of one of the straps also pertains to the other. Further, the mounting devices 104*a*, 104*b* are mirror images of each other and contain the same parts. As such, any description of one of the mounting devices also pertains to the other, albeit in a mirror image. The closure device 100 may be in the closed position (see FIG. 1) or the opened position (see FIG. 2). In the closed position, the straps 102*a*, 102*b* are connected to each other on top of the lid 4 to prevent the lid from opening (see FIG. 1). In the opened position, the straps 102*a*, 102*b* are disconnected at one end and retracted away from the lid 4 toward the mounting devices 104*a*, 104*b* to allow the lid 4 to be opened (see FIGS. 2-3).

Figure 4:
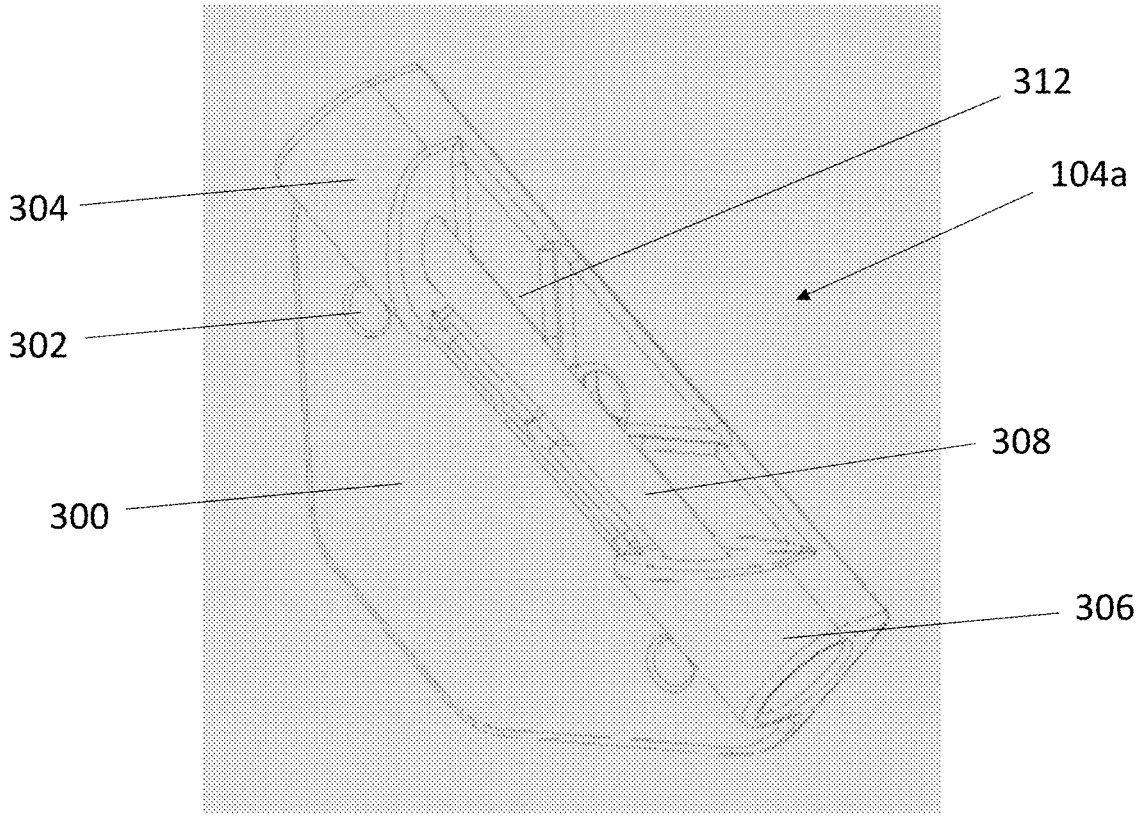
FIG. 4 shows a perspective view of a right mounting device.
Figure 5:
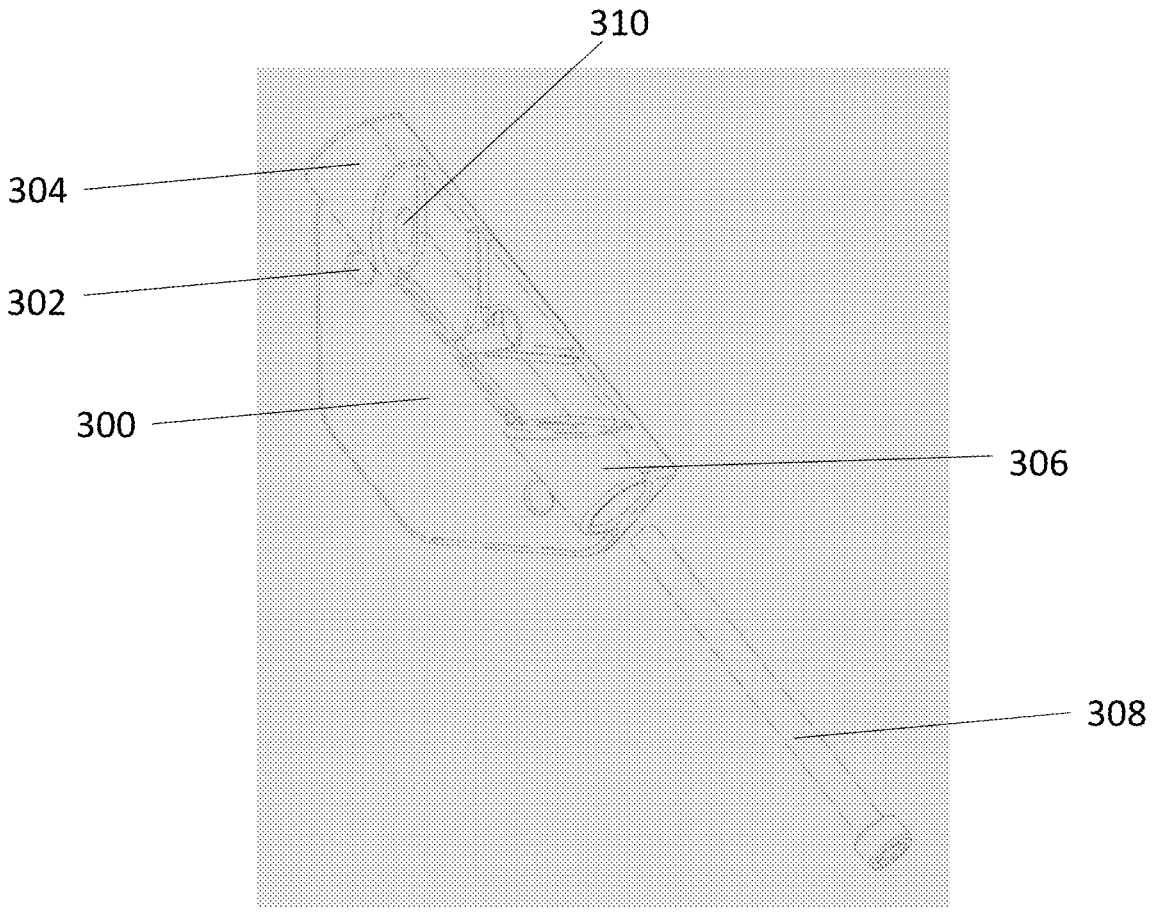
FIG. 5 shows an exploded view of the mounting device of FIG. 4.

The right side mounting device 104*a* is mounted on the right wall 6*c*; and the left side mounting device is mounted on the left wall 6*d* of the container 2. The right side mounting device 104*a* will be described herein with the understanding that a mirror image thereof (the left side mounting device 104*b*) is also mounted on the left side wall 6*d*. As shown in FIG. 4, the right side mounting device 104*a* contains a base plate 300 having one or more holes 302 therein for attaching the right side mounting device 104*a* to the right side wall 6*c* of the container 2. Mechanical fasteners, such as screws, nut/bolts, rivets, etc., may be placed through the one or more holes 302 to fix the right side mounting device 104*a* to the right side wall 6*c*. Alternatively, the right side mounting device 104*a* may be adhesively attached to the right side wall 6*c*, e.g., by glue. Preferably, the right side mounting device 104*a* is placed on the right side wall 6*c* in a position close to the lid 4 and the front wall 6*a*, near the uppermost portion of box 6. The base plate 300 contains opposing upper block 304 and lower block 306 protruding outwardly from the base plate 300. The upper and lower blocks 304, 306 position and locate a pin 308 to the right side mounting device 104*a*. Preferably, the pin 308 is threaded on one end, extends through a through hole (not shown) in the lower block 306 and threadedly engages a hole 310 (see FIG. 5) in the upper block 304. Here, the treaded end of the pin 308 is crewed into the hole 310 and is secured therein. When properly located in position, the pin 308 provides a gap 312 between itself and the base plate 300 for passage of the right side strap 102*a* therethrough, as best shown in FIG. 4. When mounted on the right side wall 6*c*, the right side mounting device 104*a* is positioned such that the upper block 304 is located closer to the lid 4 and the front wall 6*a* than the lower block 306. That position places the pin 308 at an angle about 40-50° to the horizontal, as best shown in FIG. 1, preferably about 45°.

Figure 6:
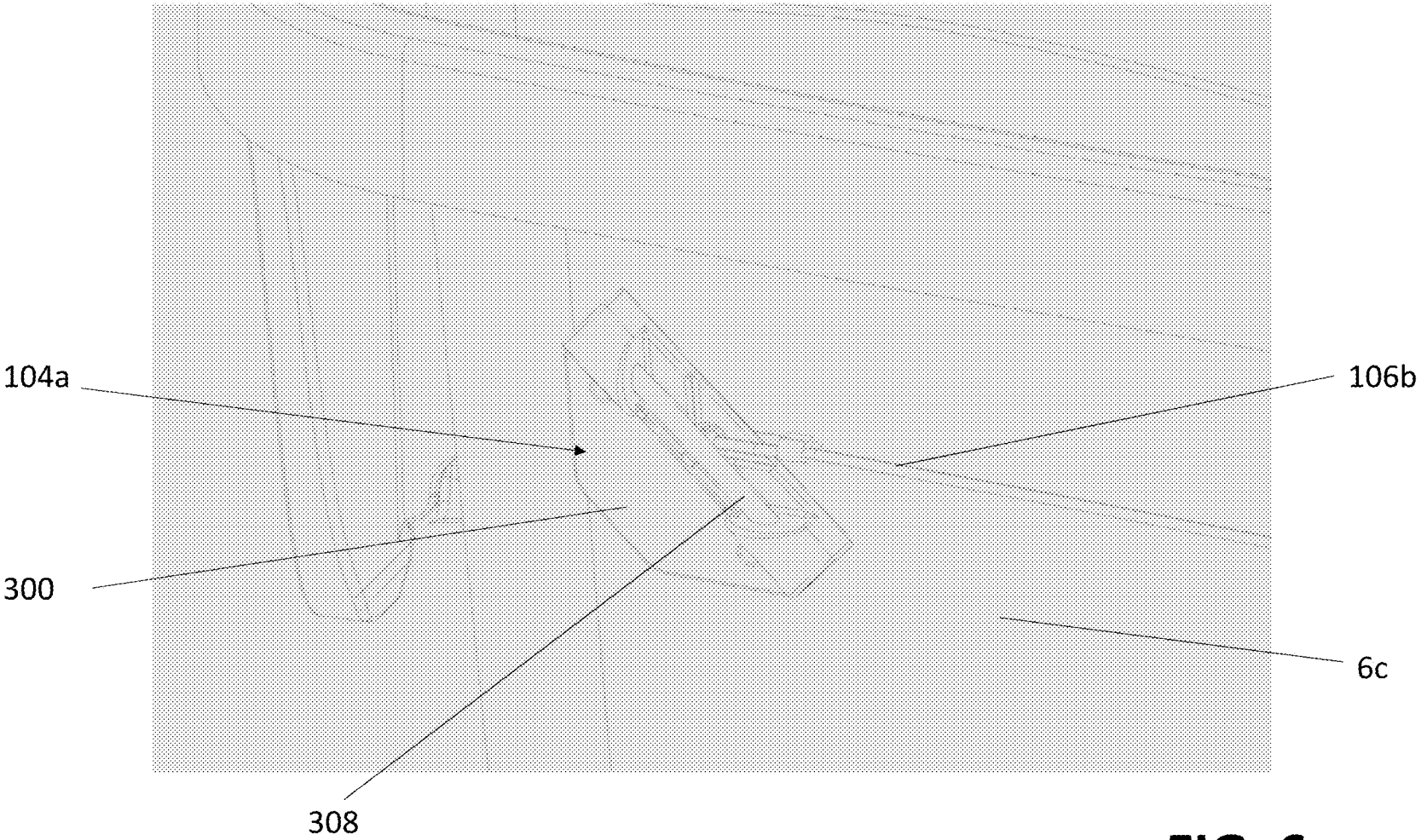
FIG. 6 shows an enlarged view of the connection between the elastic member and the mounting device of FIG. 4.
Figure 7:
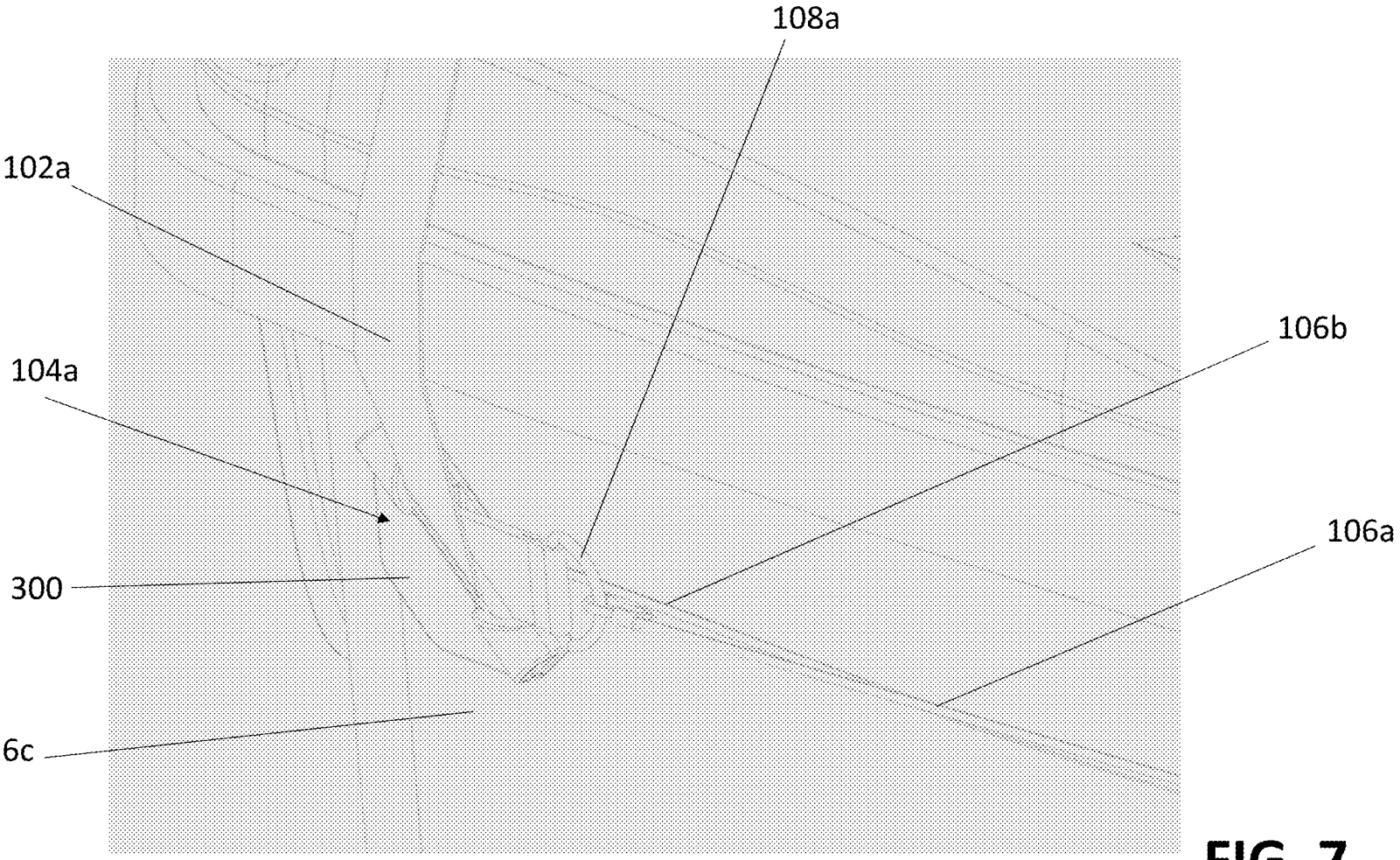
FIG. 7 shows an enlarged view of the connection between the elastic member and the strap.

As shown in FIGS. 1 and 2, the right side strap 102*a* contains a front end 103*a* and a rear end 105*a*. The front end 103*a* is fed horizontally through the gap 312 (see FIG. 4) between the pin 308 and the base 300. It should be understood that any description herein of the right side strap 102*a* also pertains to the left side strap 102*b* as it relates to the left side mounting device 104*b*. Preferably, two elastic members 106*a* and 106*b* are used. The rear end of the right side strap 102*a* is connected to a first end of the first elastic member 106*a* (see FIG. 7), preferably via a D-ring 108*a*. The second end of the first elastic member 106*a* is connected to the left side mounting device 104*b* (the mirror image of FIG. 6). Similarly, the rear end of the left side strap 102*b* is connected to a first end of the second elastic member 106*b* (the mirror image of FIG. 7). The second end of the second elastic member 106*b* is then connected to the right side mounting device 104*a* (see FIG. 6).

Alternatively, one elastic member 106 may be used. In that case, the rear end of the right side strap 102*a* is connected to the rear end of the left side strap 102*b* via the elastic member 106. The elastic member 106 may be, e.g. a bungee cord, having one end connected to a ring 108*a* at the rear end of the right side strap 102*a* and the other end connected to a ring 108*b* at the rear end of the left side strap 102*b*. Although rings 108*a*, 108*b* are shown in the drawings, the elastic member(s) 106 may be connected to the straps 102*a*, 102*b* via other mechanisms, such as holes, loops, etc. on the straps 102*a*, 102*b*. The elastic member(s) 106 horizontally connect the left side strap 102*b* to the right side strap 102*a*. Preferably, the elastic member(s) 106 is positioned around the rear wall 6*b* of the container 2 (see FIG. 3).

The free ends (the ends that are not attached to the elastic member 106, also referred to herein as the front ends 103*a*, 103*b*) of the straps 102*a*, 102*b* contain connectors 110*a*, 110*b* that allow those free ends to connect to each other (see, e.g., FIG. 1). The connectors 110*a*, 110*b* may be buckles, hook and loop connectors, etc. that allow the free ends of the straps to connect to each other. The connectors 110*a*, 110*b* are larger than the gap 312 to prevent the straps 102*a*, 102*b* from being retracted away from their respective mounting devices 104*a*, 104*b* when the connectors 110*a*, 110*b* are not connected together. Likewise, the rear ends of the straps 102*a*, 102*b* are preferably larger than the gap 312 (e.g. the rings 108*a*, 108*b*) to prevent the straps 102*a*, 102*b* from being pulled from their respective mounting devices 104*a*, 104*b*, when the straps 102*a*, 102*b* are fully pulled into the forward or upward direction.

In the closed position, as best shown in FIG. 1, the free ends of the straps 102*a*, 102*b* are pulled upwardly around the pins 308, and over the top of the lid 4. Once the free ends are connected with the connectors 110*a*, 110*b*, the elastic members 106 pull on straps 102*a*, 102*b* over the lid 4 and place the straps 102*a*, 102*b* tightly over the lid 4. In that position, the lid 4 prevented from being lifted away from the main box 6 to open the container 2.

A user can place the closure device 100 into the open position by disconnecting the connectors 110*a*, 110*b*. When the free ends of the straps 102*a*, 102*b* are disconnected, the elastic members 106*a*, 106*b* retract the straps 102*a*, 102*b* away from the lid 4. Because the connectors 110*a*, 110*b* are larger than the gaps 312, the straps 102*a*, 102*b* cannot be pulled from the mounting devices 104*a*, 104*b*. When fully retracted, the connectors 110*a*, 110*b* preferably abut their respective mounting devices 104*a*, 104*b*. When the straps 102*a*, 102*b* are retracted, the lid 4 can be lifted away from the main box 6 to open the container 2.

Although certain presently preferred embodiments of the invention have been specifically described herein, it will be apparent to those skilled in the art to which the invention pertains that variations and modifications of the various embodiments shown and described herein may be made without departing from the spirit and scope of the invention.

What is claimed is:

1. A method for closing a container, comprising the steps of a. providing a container comprising i. a main box containing a front wall, a rear wall opposing the front wall, a right wall connecting the front wall and the rear wall, and a left wall opposing the right wall and connecting the front wall and the rear wall, ii. a lid mounted on a lid hinge at the rear of the main box, iii. a first mounting device mounted to the right wall, iv. a second mounting device mounted to the left wall, v. a first strap passing through the first mounting device, and comprising a first end and a second end, vi. a second strap passing through the second mounting device, and comprising a first end and a second end, the first end of the second strap is configured to mate to the first end of the first strap on top of the lid, and vii. at least one elastic member connected to the second end of the first strap and/or the second end of the second strap, wherein the at least one elastic member is placed over the rear wall and biases the first end of the first strap toward the first mounting device and biases the second end of the second strap toward the second mounting device;

a. pulling the first ends of the first and second straps over the lid; and b. connecting the first ends of the first strap to the first end of the second strap on top of the lid.

2. The method of claim 1, wherein the connecting step involves the use of a buckle or a hook and loop connector.

3. The method of claim 1, wherein the pulling step involves wrapping the first strap around a first pin on the first mounting device, and wrapping the second strap around a second pin on the second mounting device.

4. The method of claim 1, wherein the at least one elastic member comprises an elastic member having a first end connected to the second end of the first strap, and a second end connected to the second end of the second strap.

5. The method of claim 4, wherein the elastic member biases the second ends of the first and second straps together.

6. The method of claim 1, wherein the first end of the second strap is configured to mate to the first end of the first strap by a connector.

7. The method of claim 6, wherein the connector is one of a buckle and a hook and loop connector.

8. The method of claim 1, wherein the at least one elastic member comprises i. a first elastic member having a first end connected to the second end of the first strap, and a second end connected to the second mounting device; and ii. a second elastic member having a first end connected to the second end of the second strap, and a second end connected to the first mounting device, the first and second elastic members wrap around the rear wall of the main box and bias the first and second straps toward each other.

9. The method of claim 8, wherein the first end of the first elastic member connects to the second end of the first strap via a first ring, and the first end of the second elastic member connects to the second end of the second strap via a second ring.

10. The method of claim 1, wherein the at least one elastic member comprises an elastic member having a first end connected to the second end of the first strap, and a second end connected to the second end of the second strap, the elastic member wrap around the rear wall of the main box.

11. The method of claim 10, wherein the first end of the elastic member connects to the second end of the first strap via a first ring, and the second end of the elastic member connects to the second of the second strap via a second ring.

12. The method of claim 1, wherein i. the first mounting device comprises a first base plate, a first block protruding from the first base plate, a second block protruding from the first base plate, and a first pin held between the first and second blocks to provide a first gap between the first pin and the first base plate, the first mounting device is mounted to the right wall such that the first pin extends at an angle relative to the horizontal, the first strap passes through the first gap; and ii. the second mounting device comprises a second base plate, a third block protruding from the second base plate, a fourth block protruding from the second base plate, and a second pin held between the third and fourth blocks to provide a second gap between the second pin and the second base plate, the second mounting device is mounted to the left wall such that the second pin extends at an angle relative to the horizontal, the second strap passes through the second gap.

13. The method of claim 12, wherein the pins extend at an angle of about 40-50° relative to the horizontal.

14. The method of claim 1, wherein the at least one elastic member biases the second end of the first strap and the second end of the second strap toward the rear wall of the main box.

15. A method for making a container, comprising the steps of:

a. providing a main box and a lid enclosing the main box, the main box containing a front wall, a rear wall opposing the front wall, a right wall connecting the front wall and the rear wall, a left wall opposing the right wall and connecting the front wall and the rear wall;

b. mounting a first mounting device to the right wall;

c. mounting a second mounting device to the left wall; and d. positioning a closure device on the main box, the closure device having i. a first strap placed through the first mounting device, and comprising a first end and a second end, ii. a second strap placed through the second mounting device, and comprising a first end and a second end, the first end of the second strap is configured to mate to the first end of the first strap on top of the lid, and iii. at least one elastic member connected to the second end of the first strap and the second end of the second strap, wherein the at least one elastic member is placed over the rear wall and biases the first end of the first strap toward the first mounting device and the second end of the second strap toward the second mounting device.

16. The method of claim 15, wherein the at least one elastic member comprises i. a first elastic member having a first end connected to the second end of the first strap, and a second end connected to the second mounting device; and ii. a second elastic member having a first end connected to the second end of the second strap, and a second end connected to the first mounting device, the first and second elastic members wrap around the rear wall of the main box and bias the first and second straps toward each other.

17. The method of claim 15, wherein the at least one elastic member comprises an elastic member having a first end connected to the second end of the first strap, and a second end connected to the second end of the second strap.

18. The method of claim 15, wherein the first end of the second strap is configured to mate to the first end of the first strap by a connector.

19. The container of claim 15, wherein the connector is one of a buckle and a hook and loop connector.

* * * * *